United States Patent [19]

Hess, III

[11] Patent Number: 4,907,729

[45] Date of Patent: Mar. 13, 1990

[54] SYSTEM FOR CARRYING ARTICLES

[76] Inventor: Aronld M. Hess, III, 2033 Melody La., Juno, Fla.

[21] Appl. No.: 148,603

[22] Filed: Jan. 26, 1988

[51] Int. Cl.[4] ..... A45F 5/00

[52] U.S. Cl. ..... 224/253; 224/240

[58] Field of Search ..... 224/253, 901, 195, 191, 224/270, 240; 405/186

[56] References Cited

U.S. PATENT DOCUMENTS

| | | | |
|---|---|---|---|
| 3,713,299 | 1/1973 | Duncan | 405/186 |
| 4,676,419 | 6/1987 | Victor | 224/253 |
| 4,690,316 | 9/1987 | Peterson | 224/253 |

*Primary Examiner*—Renee S. Luebke
*Attorney, Agent, or Firm*—Sybil Meloy

[57] ABSTRACT

A system for carrying articles includes belt structure and at least one detachably connectable carrying structure such as a pouch. The pouch includes direct attachment structure for securing the pouch to the belt. Loop structure on the pouch is adapted to encircle the belt whereby if the direct attachment structure becom es disengaged, the indirect attachment structure will hold the pouch to the belt. The direct attachment structure and indirect attachment structure include hook and loop fastening means. The method of manufacturing a diver's belt having at least one pouch for a lead weight including direct attachment means and indirect attachment means constructed of hook and loop fasteners.

2 Claims, 2 Drawing Sheets

FIG. 1
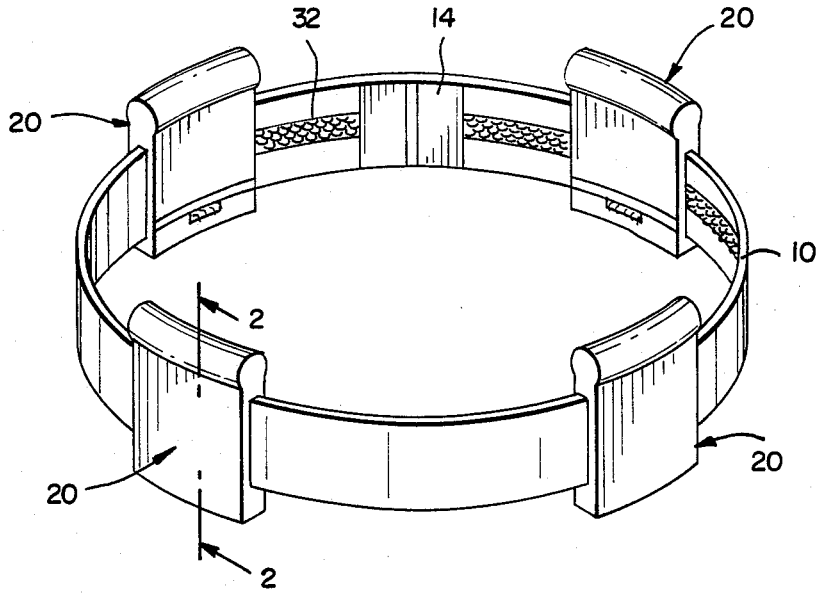
FIG. 2
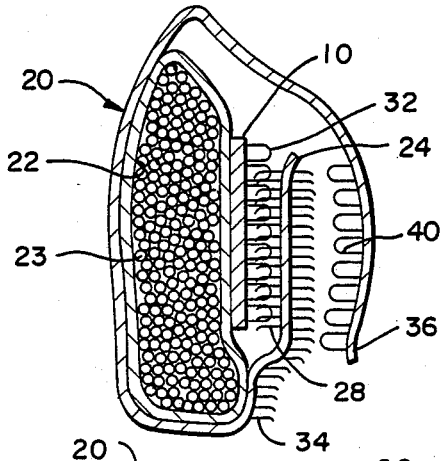
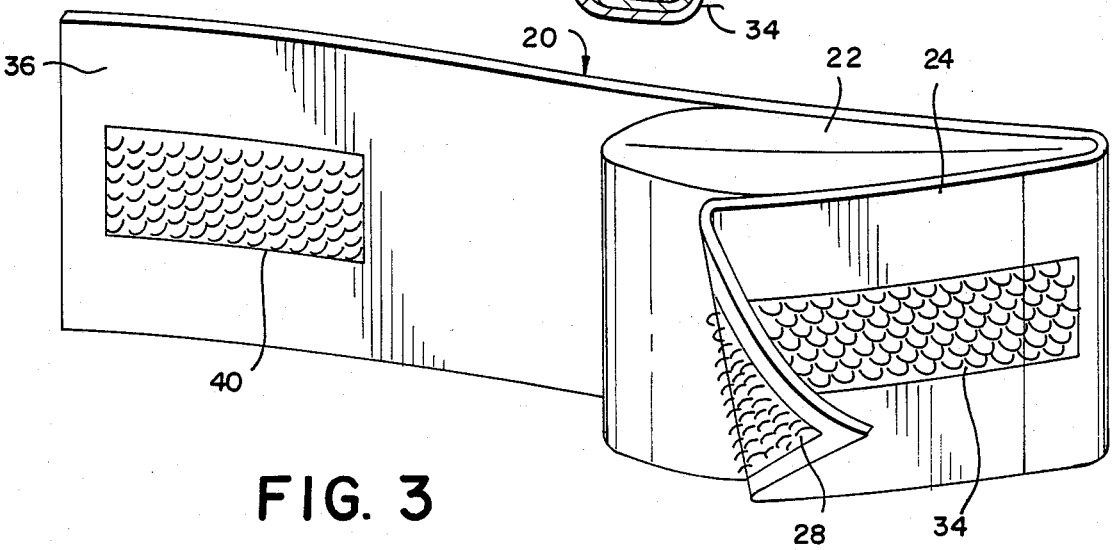
FIG. 3

SYSTEM FOR CARRYING ARTICLES

BACKGROUND OF THE INVENTION

Field of the Invention

This invention relates generally to structure for carrying articles, and more particularly to belts for carrying articles.

Description of the Prior Art

Structure for carrying articles, and particularly belts, have traditionally required the user to thread articles onto the belt. The assembly or removal process is inefficient and often requires complete disassembly of the structure in order to replace or rearrange articles on the belt. Articles can slide on the belt and therefore structure must be added to fasten the articles to the belt to prevent sliding.

It is often necessary for divers to carry additional weight on their person in order to attain proper buoyancy underwater. The amount of weight that is necessary for the diver depends on a diver's natural buoyancy as well as the buoyancy of his equipment. The diver may wish to adjust the position of the weights depending on the type and location of the equipment that the diver is wearing, and also for increasing personal comfort.

Dive belts currently in use typically include a belt and a number of solid cast weights. The weights have slotted portions to permit the belt to be threaded through them to secure the weights to the belt. The solid cast weights are also uncomfortable as they tend to press into the diver's body. Because of the threading process, traditional dive belts also allow the weights to slide if not fastened. The rigid weights can damage equipment and bruise divers as they are moved or thrown about the boat by wave action.

SUMMARY OF THE INVENTION

It is an object of the invention to provide a structure for carrying articles in which the articles can be directly attached to a belt without threading.

It is another object of the invention to provide a structure for carrying articles in which the articles will not be permitted to slide.

It is yet another object of the invention to provide a diver's weight belt which will be comfortable for the diver to wear.

It is another object of the invention to provide a diver's weight belt which will be convenient to use.

It is still another object of this invention to provide a method for manufacturing a diver's belt having at least one pouch for carrying lead weights, in which the pouch is detachably connectable to the belt using hook and loop fastening means, permitting rapid attachment and detachment of the pouches.

These and other objects are accomplished by a structure for carrying articles comprising belt means and at least one detachably connectable carrying means such as a pouch. The pouch comprises direct attachment means for securing the pouch to the belt. Indirect attachment means on the pouch are adapted to encircle the belt and hold the pouch to the belt if the direct attachment means is disengaged, inadvertently, or intentionally for repositioning the pouch during use.

The belt means preferably also comprises direct attachment means for engaging the direct attachment means of the pouch. A first flap preferably extends from the pouch and has on a first side thereof the direct attachment means. The first flap has, on a second side thereof, a first loop attachment means.

The pouch preferably also comprises a second flap extending from the pouch and having, on a side thereof, a second loop attachment means adapted to engage the first loop attachment means on the first flap, whereby the first flap can be directly attached to the belt and the first flap and the second flap can be engaged to form a loop which encircles and indirectly engages the belt.

The direct attachment means on the belt is preferably provided substantially about the longitudinal length of the belt such that the at least one pouch is universally positionable on the belt.

Thus one aspect of the invention involves a structure having carrying means for carrying articles, comprising belt means provided substantially about the length thereof with direct attachment means; a pouch having direct attachment means for said pouch to said belt; and a flap adapted to form a loop which encircles said belt, said flap having indirect attachment means to engage said pouch and which thus indirectly engages the belt. A second flap can be used, so that one of the flaps is directly engagably to the second flap to indirectly engage said belt.

Manufacturing the structure of this invention, a diver's belt, having at least one pouch for a lead weight, being selectively positionable on said belt comprises attaching direct attachment means substantially about the longitudinal length of said belt, providing a pouch; attaching direct attachment means to said pouch for attachment to said belt, said direct attachment means on said belt and pouch being hook and loop fasteners and providing a flap which can be engaged to form a loop which encircles the belt and attaches to said pouch by indirect attachment means, thereby indirectly attaching said belt, said attachment means being hook and loop fasteners.

The attachment means, as shown in the drawings, can be constructed so that the indirect attachment means can overlay the direct attachment means, to provide a diving belt in which weights are positionable about the length of the belt, and are easily detachable; yet are adapted to be maintained attached to the belt under diving conditions.

The attachment means preferably comprises a releasable fastening system, such as that known by the trademark Velcro. A Velcro strip can be placed substantially about the longitudinal length of the belt. A cooperating Velcro strip can be provided on the first side of the first flap whereby the pouch can be directly attached to the belt substantially anywhere on the longitudinal length of the belt. Velcro can also be provided as the loop attachment means. A strip of Velcro can be provided on the second side of the first flap and a cooperating Velcro strip can be provided on the second flap, whereby the second flap can be joined to the second side of the first flap to form a loop for indirectly attaching the pouch to the belt.

The articles contained within the pouch can include weights, gloves, catch nets, compasses, dive gear, and any other article dimensioned such that an individual can carry it. Dive weights preferably are weights suitable for use in an underwater environment, and preferably comprise materials which will not rust. Lead is a preferable material and most preferably is provided in the form of lead shot. The lead shot is easily contained within the pouch and conforms to the diver's body without edges that press into the diver's body.

The present invention preferably utilizes a pouch to carry the articles. It will be understood, however, that the carrying means could alternatively be clips, rings or any other means for retaining articles. These devices can be secured to belt means, by the principles of the invention.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a perspective view of a dive belt according to the invention.

FIG. 2 is a cross-section taken along line 2—2 in FIG. 1.

FIG. 3 is a perspective of a dive pouch.

DETAILED DESCRIPTION OF THE PREFERRED EMBODIMENTS

Figure 4:
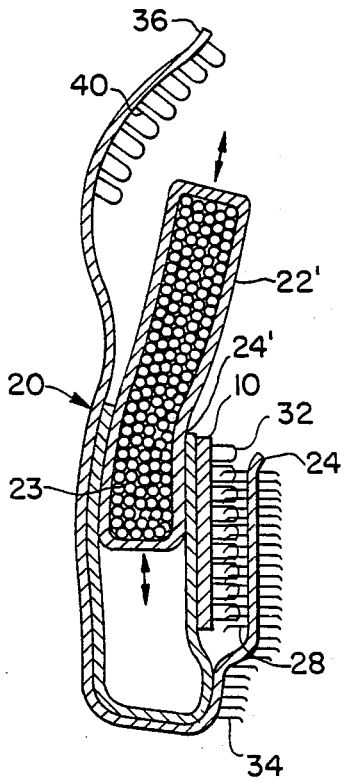
FIG. 4 is a perspective view of a sack being inserted into the pouch.

Referring to FIGS. 1–3, where like numbers refer to like elements, a belt 10 is provided. The belt 10 can have a buckle 14. The buckle 14 can be provided in any form suitable for this purpose. At least one detachably connectable carrying means such as the pouch 20 and usually a plurality of pouches as shown or other carrying means will be preferable.

A pouch 20 preferably comprises an enclosed sack portion 22. Preferably enclosed within the sack portion 22 is a weight material 23, although other articles could be substituted for the weights. The pouch 20 includes means for directly attaching the pouch 20 to the belt 10. The pouch 20 preferably comprises a first flap 24. The first flap 24 has, on a first side thereof, the direct attachment means. The belt 10 also preferably comprises means for directly attaching the pouch 20 to the belt 10. The direct attachment means preferably comprises cooperating hook and loop fastening means such as Velcro strips on the belt 10 and the pouch 20. The direct attachment means preferably comprises a strip of Velcro such as the hook portion 28 on the first flap 24 which cooperates with a loop portion 32 on the belt 10.

The first flap 24 includes, on a second side thereof, a first loop attachment means, which preferably is a Velcro strip such as the hook portion 34. A second flap 36 extends from the pouch and forms a part of the loop adapted to encircle the belt 10. The second flap has, on a side thereof, a second loop attachment means, preferably a cooperating strip of Velcro such as the loop portion 40. The attachment means of the invention permits articles to be placed directly on the belt 10 without the need of threading the articles onto the belt 10. The articles are held securely to the belt 10 and will not slip or slide.

Preferably enclosed within the sack portion 22 is a weight material 23. The weight material 23 is preferably adapted for underwater use and therefore is substantially rust resistant. Lead shot is a preferable weight material. The lead does not rust and the shot conforms to the diver's body. The shot lacks the rigid edges which press into and bruise the diver's body and which can damage equipment if contact is made. Other weight materials are also possible, including metals encased in plastic.

The belt can be used to carry articles other than, or in addition to, weights. The pouches 20 can be formed with a sack portion 22' as shown in FIG. 4 and having a reclosable opening 24' through which articles can be placed in or removed from the pouch. Various articles can be kept in the pouch, which is substantially universally positionable about the belt for the convenience of the diver. The pouch 20 can alternatively be replaced with clips, rings or other fastening means to secure articles to the belt without enclosing the articles in a pouch.

The belt and pouch are preferably formed from materials which can withstand the aquatic environment. Synthetic polymers such as nylon are preferable materials because of their strength and durability.

The belt and pouch are constructed by attaching attachment means substantially about the length of said belt, and attaching direct attachment means on said pouch, namely hook and loop fasteners, then finally providing a flap which can be engaged to form a loop which encircles the belt and attaches to said pouch by indirect attachment means and thereby indirectly attaching said belt, the attachment means being hook and loop fasteners. As shown in the drawing the hook and loop fasteners are conveniently provided on belt 10, on one side of the flap 40 and on both sides of the additional flap 32. By attaching the direct and indirect attachment means in this manner, the direct attachment between the belt and flap 32 cannot be disengaged until detachment of the indirect attachment means formed by the hook and loop fasteners on flap 36 in cooperation with the hook and loop fasteners on flap 34.

This invention can be embodied in other forms without departing from the spirit or essential attributes thereof, and accordingly, reference should be had to the following claims, rather than to the foregoing specification, as indicating the scope of the invention.

I claim:

1. A structure having means for carrying articles, comprising:

belt means provided substantially along the length thereof with direct attachment means;

a pouch having direct attachment means for securing said pouch directly to said belt;

said direct attachment means being hook and loop fastening means;

a flap extending from said pouch adapted to form a loop which encircles said belt, said flap having indirect attachment means which engages said pouch, thereby indirectly engaging said belt, said indirect attachment means comprising hook and loop fastening means;

an additional flap on said pouch containing said direct attachment means on one side thereof said indirect attachment means on the opposite side thereof, whereby said direct attachment means on said additional flap is adapted to directly engage said belt and said indirect attachment means on said additional flap is adapted to engage said indirect attachment means on said other flap and to overlay the direct attachment means in use; and said pouch having a reclosable opening and having a sack therein adapted to hold lead shot.

2. The method of manufacturing a diver's belt, having at least one pouch for lead weight, said pouch being selectively positionable, comprising:

attaching direct attachment means substantially along the length of said belt;

providing a pouch;

attaching direct attachment means to said pouch for direct attachment to said belt, said direct attachment means on said belt and pouch being hook and loop fasteners;

providing a flap having indirect attachment means, which flap can be engaged to form a loop, which encircles the belt and is attachable to said pouch by said indirect attachment means, and which overlays the direct attachment means during use, said indirect attachment means being hook and loop fasteners; and providing the pouch with a reclosable opening and a sack and adapted to hold lead weights or shot.

* * * * *